US008056637B2

(12) United States Patent
Larnach

(10) Patent No.: US 8,056,637 B2
(45) Date of Patent: Nov. 15, 2011

(54) SUBSURFACE SAFETY VALVE AND METHOD FOR CHEMICAL INJECTION INTO A WELLBORE

(75) Inventor: Alan Larnach, Montrose (GB)

(73) Assignee: Chevron U.S.A. Inc., San Ramon, CA (US)

( * ) Notice: Subject to any disclaimer, the term of this patent is extended or adjusted under 35 U.S.C. 154(b) by 421 days.

(21) Appl. No.: 12/263,267

(22) Filed: Oct. 31, 2008

(65) Prior Publication Data

US 2010/0108320 A1 May 6, 2010

(51) Int. Cl.
*E21B 34/10* (2006.01)

(52) U.S. Cl. ..... 166/375; 166/322

(58) Field of Classification Search ..... 166/310, 166/319, 322, 332.8, 375
See application file for complete search history.

(56) References Cited

U.S. PATENT DOCUMENTS

| | | | | |
|---|---|---|---|---|
| 6,991,040 | B2 | 1/2006 | Hill, Jr. et al. | |
| 7,188,674 | B2 | 3/2007 | McGavern et al. | |
| 7,198,099 | B2 | 4/2007 | Lugtmeier et al. | |
| 7,637,326 | B2 * | 12/2009 | Bolding et al. | 166/375 |
| 2008/0169106 | A1 | 7/2008 | Hill et al. | |
| 2008/0230231 | A1 | 9/2008 | Bolding et al. | |
| 2008/0308268 | A1 * | 12/2008 | Hill et al. | 166/129 |

FOREIGN PATENT DOCUMENTS

WO WO2007073401 6/2007

* cited by examiner

*Primary Examiner* — David Andrews
(74) *Attorney, Agent, or Firm* — Alan W. Klaassen

(57) ABSTRACT

A subsurface safety valve is modified to permit the passage of a downhole treatment chemical through the valve while bypassing a valve closure member which is maintained within the safety valve in operative condition.

22 Claims, 4 Drawing Sheets

SUBSURFACE SAFETY VALVE AND METHOD FOR CHEMICAL INJECTION INTO A WELLBORE

FIELD OF THE INVENTION

The present invention is directed to a safety valve assembly and to a method for passing chemicals to the production tubing in a wellbore while maintaining a working safety valve for emergency stoppages of production fluids.

BACKGROUND OF THE INVENTION

This invention is related generally to the delivery of chemicals to a wellbore during petroleum production operations. In one embodiment, the invention relates to a method for delivering chemicals through a subsurface safety valve while maintaining suitable protection of the well in the event that the control of fluid flow from the well is lost.

During typical hydrocarbon production operations in a producing well, it may be desirable to add chemicals from a surface facility into the producing well to facilitate the production of liquids from the well or to protect the well from erosion, corrosion or scale build-up. Foaming agents may be added to the well to mitigate the effect of an accumulation of liquids in the production tubing. Under certain conditions, the accumulated liquids (e.g. liquid water or condensate) may restrict the upward flow of fluids through the tubing to the surface facility. Using the foaming agent to converting at least a portion the liquid in the production tubing to a foam helps reduce the back pressure created by the condensate and permits higher hydrocarbon recovery rates from the well. Chemicals, such as foam-forming chemicals, may be added into the production tubing through small diameter tubing which passes down into the well within the production tubing. Scale inhibitors and corrosion inhibitors may be added in the same way to help protect the integrity of the production tubing against chemical attack or degradation.

One feature of many modern wells is a subsurface safety valve (SSV) which is fitted into production tubing in the wellbore, generally several hundred feet below mudline. Subsurface Safety Valves operate to block the flow of formation fluids upwardly through the production tubing should a failure or hazardous condition occur at the surface facility or within the production tubing itself. The SSV typically employs a valve closure member, or "flapper," that is moveable between an open position and a closed position, with the flapper pivotally mounted to a hard seat. In its open position, the flapper pivots away from the hard seat, thereby opening the bore of the production tubing. However, the flapper is strongly biased to its closed position. When the flapper is closed, it mates with the hard seat and prevents hydrocarbons from traveling up the wellbore to the surface. The flapper plate of the safety valve is held open during normal production operations by the application of hydraulic fluid pressure transmitted to an actuating mechanism. A common actuating mechanism is a cylindrical flow tube, which is maintained in a position adjacent the flapper by hydraulic pressure supplied through a supply conduit extending to the surface facility. The supply conduit is normally installed within the annulus between the production tubing and the well casing. Hydraulic fluid within the supply conduit feeds against a piston. The piston, in turn, acts against the cylindrical flow tube, which in turn moves across the flapper within the valve to hold the flapper open. When a catastrophic event occurs at the surface, somewhere along the production tubing or within the hydraulic system, hydraulic pressure from the supply conduit is interrupted, causing the cylindrical flow tube to retract, and allowing the flapper of the safety valve to quickly close. When the safety valve closes, it blocks the flow of production fluids up the tubing. Thus, the SSV provides automatic shutoff of production flow in response to well safety conditions that can be sensed and/or indicated at the surface. Examples of such conditions include a fire on an offshore platform, sabotage to the well at the earth surface, a high/low flow line pressure condition, a high/low flow line temperature condition, and simple operator override. This feature is particularly important for underwater wells, where an uncontrolled fluid flow from the well would be very difficult to manage.

Producing wells with an installed chemical delivery system providing an uninterrupted length of tubing extending from the surface facility to the producing fluids within the well are incompatible with a fitted SSV, since the chemical delivery line extending through the SSV would interrupt the safe operation of the SSV. As a consequence, it is desirable to modify the chemical delivery system to achieve the desired compatibility with an SSV fitted into the production tubing. WO2007/073401 provides a first injection conduit in fluid communication with a first hydraulic port above a subsurface safety valve, a second injection conduit in fluid communication with a second hydraulic port below the subsurface safety valve, and a fluid pathway to bypass the valve and allow hydraulic communication between the first hydraulic port and the second hydraulic port.

U.S. Pat. No. 7,198,099 suggests supplying a chemical treatment fluid in a system which permits the use of the treatment fluid for controlling the subsurface safety valve within a wellbore. Treatment fluid is supplied at a pressure greater than a threshold pressure to maintain the valve in an open position, to permit hydrocarbon flow up through the production tubing. If the pressure within the treatment fluid supply line is increased beyond a second threshold pressure, a one-way check valve within the supply system opens, allowing treatment fluid to flow into a treatment fluid injection conduit and then into the well.

SUMMARY OF THE INVENTION

In an embodiment of the invention, a safety valve assembly is provided for passing chemicals to the production tubing in a wellbore while maintaining a working safety valve for emergency stoppages of production fluids. The safety valve assembly comprises an outer housing comprising a $1^{st}$ supply conduit for supplying a $1^{st}$ fluid to the safety valve assembly and a $2^{nd}$ supply conduit for supplying a $2^{nd}$ fluid to the safety valve assembly; an inner housing fixed within the outer housing and comprising a valve closure member and a $3^{rd}$ supply conduit for supplying the $2^{nd}$ fluid to the wellbore; a $1^{st}$ annular volume positioned between the outer housing and the inner housing, the $1^{st}$ annular volume being in fluid communication with the $1^{st}$ supply conduit and with the $3^{rd}$ supply conduit; and a $2^{nd}$ annular volume positioned between the outer housing and the inner housing, the $2^{nd}$ annular volume being in fluid communication with the $2^{nd}$ supply conduit; wherein the valve closure member in the inner housing is responsive to pressure changes of the $2^{nd}$ fluid.

The safety valve assembly is prepared in place in the production tubing within a wellbore. Thus, the machined port is formed within the safety valve assembly which is installed in the wellbore, with the safety valve assembly being attached at a first end to at least one length of production tubing and at a second end to at least one length of production tubing. In embodiments, the outer housing of the safety valve assembly is attached at a first end to at least one length of production tubing and at a second end to at least one length of production tubing.

The safety valve assembly comprises two subsurface safety valve (i.e. SSV) units. A $1^{st}$ SSV forms the outer housing of the safety valve assembly, and is installed in the production tubing within a wellbore. Modifications of the $1^{st}$ SSV according to the method of the invention prepare for the insertion of a $2^{nd}$ SSV as an inner housing within the outer housing. Modifications to the $1^{st}$ SSV include disabling a valve closure member and redirecting a flow path for a $1^{st}$ fluid to use as a chemical flow path by forming a machined port within the outer housing. The inner housing then provides the valve closure for maintaining the protection of the wellbore and flowing production fluids from catastrophic failure. Accordingly, the method for delivering a chemical treatment fluid to a wellbore, comprises installing a $1^{st}$ safety valve, comprising a $1^{st}$ supply conduit, a $2^{nd}$ supply conduit, a $1^{st}$ fluid chamber and a $1^{st}$ valve closure member, into a wellbore; forming a machined port in an inner wall of the $1^{st}$ safety valve to produce a pathway for fluid flow through the inner wall from the $1^{st}$ fluid chamber; installing a $2^{nd}$ safety valve within the $1^{st}$ safety valve, wherein the $2^{nd}$ safety valve comprises a $2^{nd}$ valve closure member and a $3^{rd}$ supply conduit; and passing a $1^{st}$ fluid through the $1^{st}$ supply conduit, the $1^{st}$ fluid chamber and the machined port and into the $3^{rd}$ supply conduit for chemical treatment of a production fluid and/or a production tubing.

DETAILED DESCRIPTION OF THE INVENTION

Figure 1:
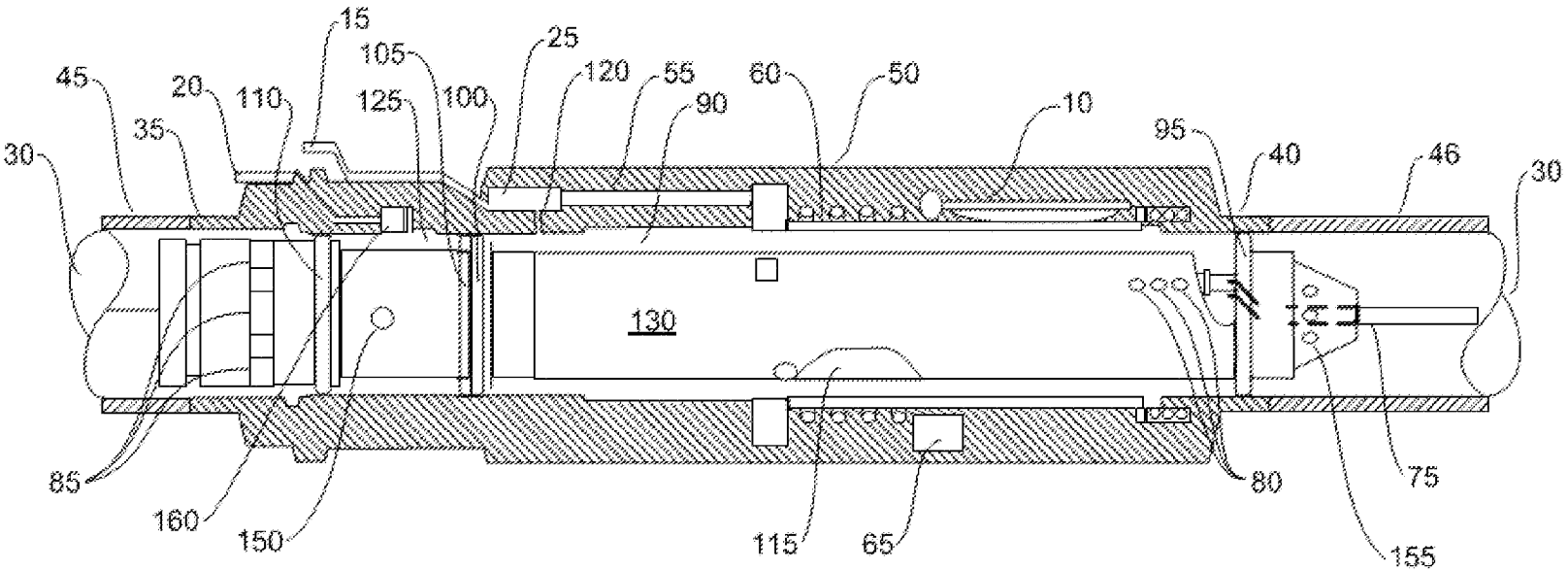
FIG. 1 illustrates an embodiment of the safety valve assembly, showing the inner housing positioned within the outer housing and the modifications made to the outer housing to permit the flow of a chemical fluid bypassing a valve closure member, permitting the injection of chemicals into the wellbore while maintaining the protection provided by the valve closure member.

A subsurface safety valve (SSV) is a safety device installed in a wellbore to provide emergency closure of the production tubing in the event of an emergency. The SSV may be surface controlled or subsurface controlled. In each case, the safety valve assembly is designed to be fail-safe, so that the wellbore is isolated in the event of any system failure or damage to the surface facilities. A surface-controlled subsurface safety valve (SCSSV) is a safety device that is operated from surface facilities through one or more supply conduit. In embodiments, the supply conduit is strapped to the external surface of the production tubing. Two basic types of SCSSV are common: wireline retrievable, whereby the principal safety valve components can be run into, and retrieved, from production tubing on wireline; and tubing retrievable, in which the entire safety valve assembly is installed with the tubing string. The control system operates in a fail-safe mode, with hydraulic control pressure used to hold open a ball or flapper assembly that will close if the control pressure is lost.

A tubing retrievable subsurface safety valve (TRSSV) in fitted into and integral with the production tubing, and is installed and removed from the wellbore along with the production tubing. A tubing retrievable, surface controlled subsurface safety valve (TRSCSSV) is controlled from a surface facility.

A wireline retrievable subsurface safety valve (WRSSV) can be run and retrieved by wireline or slickline. The valve assembly is lowered into previously installed production tubing within the wellbore, and inserted into a device in the production tubing that is equipped with a supply conduit connected to the surface control system. During the lowering or retrievable operation, the WRSSV may be suspended on a cable or ribbon. Often an electrical cable is used to run, install and retrieve the WRSSV. In embodiments, a wireline retrievable safety valve is installed within an already installed tubing retrievable safety valve.

A surface facility is any structure for controlling the operation of an SSV. The surface facility may also be a terminus of the production tubing for recovering hydrocarbons from a wellbore. The surface facility may also have the capability of supplying chemicals to the wellbore. In sea-based hydrocarbon recovery operations, the surface facility may be termed a platform, such as a production platform, which is positioned on or slightly above the sea surface. Alternatively, the surface facility may be positioned on the seabed, and controlled remotely from a land based operation or from a drilling or production platform. In land based operations, the surface facility may be located on the land surface near to, or coincident with the upper terminus of the production tubing.

A valve closure member is an element within the SSV which can be activated to close off the flow of produced fluids in the production tubing. In embodiments, the valve closure member is a spring-loaded plate (or flapper). In conventional operation, the valve closure element (or flapper valve) is fully open, to permit the flow of produced fluids through the production tubing.

The production tubing is conduit within a wellbore for conducting hydrocarbons and/or water from their source(s) to the surface. Fluids passing through production tubing are often termed produced fluids.

The safety valve assembly to which the present invention is directed includes at least a $1^{st}$ subsurface safety valve (i.e. $1^{st}$ SSV) and a $2^{nd}$ subsurface safety valve (i.e. $2^{nd}$ SSV). A $1^{st}$ SSV comprises a $1^{st}$ valve closure member in communication with at least one supply conduit for controlling the action of the valve closure member. In embodiments, the $1^{st}$ SSV is connected to a $1^{st}$ supply conduit for hydraulically controlling the action of the valve closure member, and a $2^{nd}$ supply conduit as a back-up to the primary supply conduit. The supply conduits are generally small diameter tubing extending from the surface facility, either through the annular space between the sides of the wellbore and the production tubing, and to the SSV, or within the production tubing to the SSV. Fluid contained within the supply conduit is hydraulically coupled to a linkage mechanism in the SSV for maintaining the valve closure member in an open position when the hydraulic pressure is maintained at a sufficiently high level. Hydraulic pressure is controlled from the surface facility, providing for the surface controlled feature of the SSV. Conventionally, the $2^{nd}$ supply conduit is plugged within the SSV, and is prevented from communicating hydraulically with the remainder of the SSV. Use of the $2^{nd}$ supply conduit in this configuration generally requires removing the plug. Tools suited for removing the plug or opening the plugged region to fluid flow are available and routinely used.

A delivery line is provided for delivering a $1^{st}$ fluid into the produced fluids. In embodiments, the $1^{st}$ fluid is suitable for chemical treatment of the production fluids passing through the safety valve assembly, and/or is suitable for chemical treatment of the production tubing within the wellhead. Typical chemicals which may be added include foaming agents, water or salt inhibitors for prevention of salt deposition, corrosion inhibitors, scale inhibitors, paraffin inhibitors, hydrate inhibitors, sulfur block inhibitors, friction reducers, clay control additives, wetting agents, fluid loss additives, emulsifiers, agents to prevent the formation of emulsions, fibers, breakers and consolidating materials. Foam forming chemicals may be desired to facilitate the production of gaseous hydrocarbons in the presence of significant amounts of liquid within the production tubing. Anti-scale chemicals or corrosion inhibitors may be added to protect the inside wall of the production tubing.

The present invention provides a system and a method for delivery chemicals to a hydrocarbon producing system without having to withdraw an installed SSV and without impeding the operation of a valve closure member within the SSV. In embodiments, the system provides a $1^{st}$ SSV with at least two control systems. A $1^{st}$ hydraulic control system is modified to permit the delivery of chemicals through the SSV to the chemical delivery line which extends below the SSV; a $2^{nd}$ hydraulic control system is modified to control a valve closure member in a $2^{nd}$ SSV.

Figure 2:
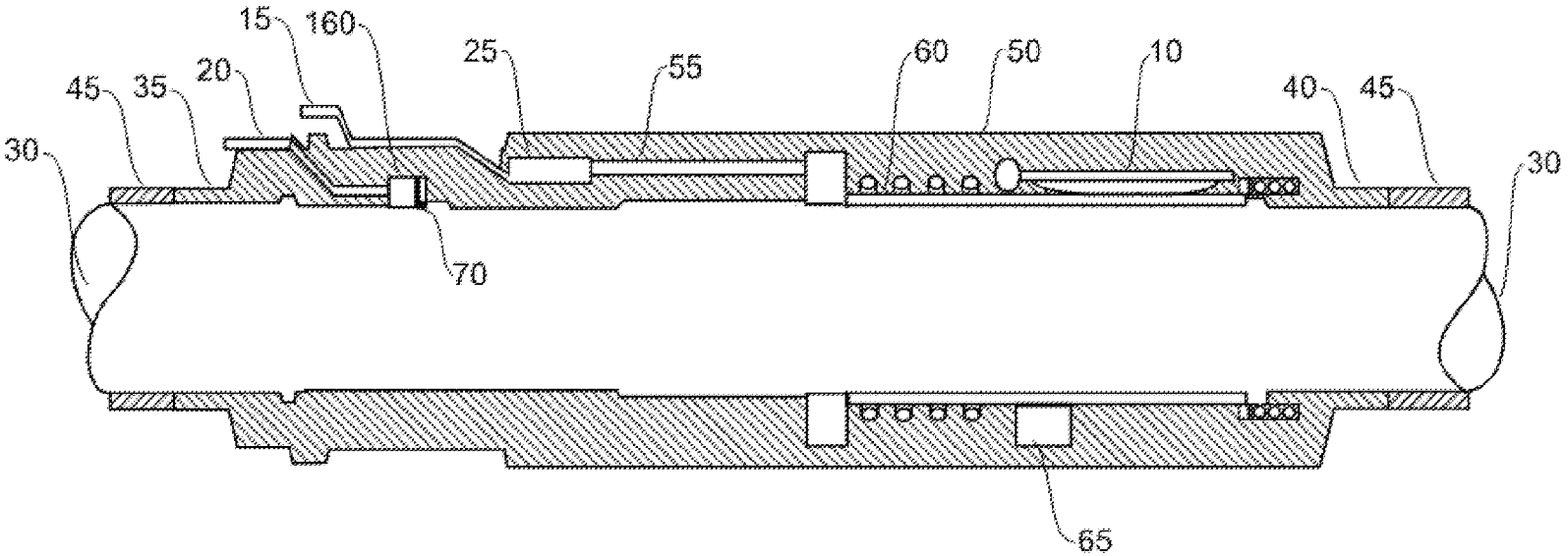
FIG. 2 illustrates an embodiment of a conventional tubing retrievable subsurface safety which is modified and used as the outer housing of the safety valve assembly.

An embodiment of a safety valve assembly of the present invention is illustrated in FIG. 1. As shown, the safety valve assembly comprises a $1^{st}$ SSV 50 and a $2^{nd}$ SSV 130. The $1^{st}$ SSV is more specifically illustrated in FIG. 2. The SSV encloses a flow path 30 through which produced fluids pass, enroute to surface facilities. In embodiments, the $1^{st}$ SSV shown in FIG. 2 is a tubing retrievable subsurface safety valve (TRSSV). In some such embodiments, the $1^{st}$ SSV is a tubing retrievable, surface controlled subsurface safety valve (TRSCSSV). The $1^{st}$ SSV is attached at a first end 35 to at least one length of production tubing 45 extending from the SSV toward the surface facility (not shown), and at a second end 40 to at least one length of production tubing 46 extending downward further into the wellbore. The $1^{st}$ SSV is supplied with a valve closure member 10 to provide a means for blocking fluid flow through the SSV, should an emergency situation occur. In FIG. 2, the valve closure member is shown in the open position, permitting the flow of produced fluids through the production tubing.

In the embodiment illustrated in FIG. 2, the $1^{st}$ SSV 50 comprises at least 2 supply conduits. A $1^{st}$ supply conduit 15 is connected into the $1^{st}$ SSV 50, leading to the $1^{st}$ fluid chamber 25. During conventional operation, hydraulic fluid within the $1^{st}$ fluid chamber 25 is supplied under pressure from the surface facility (not shown). A suitable operating pressure is established by the conditions within the well and by the design pressure of the particular valve assembly being employed. Typical hydraulic pressures are in the range of 100 psig to 10,000 psig. The hydraulic fluid is selected to remain thermally stable at all conditions which are expected for a particular application. Examples include hydraulic oils, including aviation grade hydraulic oils, mineral oils, aqueous solutions, water/glycol mixtures. In unusually cold environments, low viscosity fluids may be selected.

During conventional operation of the SSV, the valve closure member 10 is maintained in an open, flow position as a result of hydraulic pressure being exerted against the linkage elements within the valve. In the embodiment illustrated in FIG. 2, hydraulic fluid within a fluid chamber 30 urges a piston 55 against a spring loaded sleeve 60 which maintains the valve closure member 10 in an open position. Should the hydraulic pressure be reduced or lost for any reason, the sleeve is forced upward by the spring, freeing the valve to close against the valve seat 65 and effectively shutting off the flow of production fluid through the SSV.

Modifications of the $1^{st}$ SSV to permit chemical delivery using the $1^{st}$ supply conduit 15 include disabling the valve closure member 10 of the $1^{st}$ SV. In an embodiment, the valve closure member 10 of the SSV is permanently locked into an open position using a lockout tool. An example tool to accomplish this modification is described, for example, in U.S. Pat. No. 6,991,040. In one embodiment, a lockout tool is lowered into the SSV, shouldering against the spring loaded sleeve and driving the sleeve down over the flapper valve, thereby maintaining the flapper of the SSV in its open position. Within the lockout tool are design features which can be caused to expand outward against the spring loaded sleeve, permanently deforming the sleeve in such a way as to develop a permanent, frictional engagement with a hard seat within the SSV. This, in turn, locks the flapper member of the SSV in its open position.

The $1^{st}$ SSV is modified further for chemical delivery by enabling the $2^{nd}$ supply conduit 20 for fluid communication with the safety valve assembly. As noted above, in some types of conventional operation, a shear plug 70 in the $2^{nd}$ control system prevents fluid flow between the $2^{nd}$ supply conduit 20 and the SSV. In embodiments, the $2^{nd}$ supply conduit 20 is activated as the primary source of control for the operating valve closure member 10 by removing the shear plug 70 which caps off the $2^{nd}$ supply conduit. Tools for accomplishing this task are available and used commercially.

Thus, in the operation of the SSV of this invention, the SSV is modified to provide for chemical delivery through the $1^{st}$ supply conduit 15. The $2^{nd}$ supply conduit 20 is further activated through modifications as described to provide for control of a $2^{nd}$ valve closure member 10, which is installed as part of the modification. By use of the $1^{st}$ supply conduit for delivery of chemicals, the chemical delivery can be made to bypass the valve closure member 10, without creating obstructions to safe operation of the valve. Further, by use of the $1^{st}$ supply conduit 10 for delivery of chemicals, chemical injection can be initiated without withdrawing the production tubing from the wellbore.

An additional modification to the $1^{st}$ SSV creates an opening 120 in the $1^{st}$ fluid chamber 25, to allow for bidirectional fluid communication between the SSV and the $1^{st}$ fluid chamber 25. In some such embodiments, the opening 120 is produced by a cutting tool, such as a wireline cutting tool which comprises a cutting element contained therein, which is inserted into the installed SSV. When inserted, the cutting element is activated against an inner surface of the $1^{st}$ SSV, caused to pierce the inner wall and extending the opening into the fluid chamber 25 to the extent necessary to provide a suitable flow of chemicals through the opening. A tool useful for this purpose is configured to accurately position a cutting element at a location along the length of the SSV to form an opening of a predetermined dimension within the wall of the SSV and into the $1^{st}$ fluid chamber 25, while avoiding contact with other elements, such as the piston rod 55, within the SSV. An exemplary tool which is useful for creating this opening is a Sondex-type tool, supplied. An example by Westerton.

Figure 3:
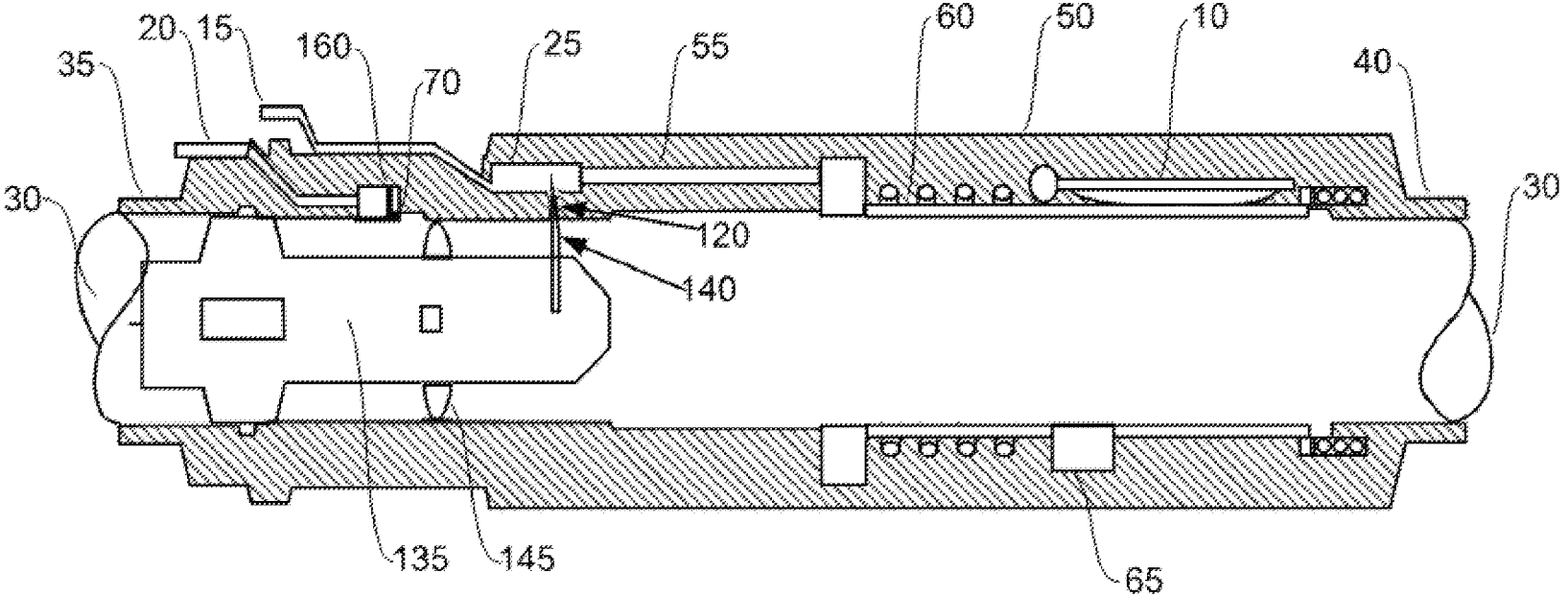
FIG. 3 illustrates an embodiment of the cutting tool preparing the machined port within the outer housing of the safety valve assembly.

FIG. 3 illustrates an embodiment, showing a wireline cutting tool 135 that has been lowered into the SSV until is rests against a step feature within the flow path 30 of the SSV. A centralizer 145 keeps the tool centered in the flow tube. After the tool has been suitably positioned, a cutting blade 140 pierces the inner wall of the SSV in such a way as to avoid weakening the structural integrity of the SSV and to avoid contacting the piston 55 with the cutting blade 140, while making an opening of sufficient area to permit the desired chemical flow. In embodiments, this cutting tool is a wireline tool, lowered from and electrically driven from the surface facility. Computer control from the surface can be used to monitor and record the number of rotations, the torque and the depth of cut. This high level of control permits cutting into the valve to a predetermined depth so as to provide a cut of sufficient size to permit the desired fluid flow therethrough, without compromising the structural integrity of the valve. For example, the cutting tool may be accurate to 0.005" or better in establishing the depth and width of the cut. In addition, accurate cutting of the SSV may be aided by surface calibration of the tool, using an electronic fingerprint generated at the surface, to be replicated during operation in the installed TRSSV, to ensure the recommended cut depth and to maintain full control and knowledge at all times.

As the tool cuts in increments, e.g. 0.002" per revolution, the generated swarf or debris is swept back into the well bore. When the allocated depth has been reached, the drive may be stopped and reversed to retract the blade at the same increment, thus sweeping any remaining debris out of the cut. In one embodiment, the cutting blade 140 has a flat cutting profile, with a width in the range of 1 mm to 5 mm. A 2.5 mm cutting blade is exemplary. In another embodiment, the cutting blade has a triangular tip.

To eliminate any residual "burrs" which may be formed during the cutting step, a rotating polishing head may be further employed within the SSV to polish across the cut area, removing any detrimental impact of the cutting operation to the polished surface of the inside surface of the SSV. Among other factors, the polishing operation helps to ensure that the 2.5 mm cut does not affect the sealing packing stack of the insert. After completion of the opening, the wireline cutting tool is withdrawn from the $1^{st}$ SSV.

The modifications to the $1^{st}$ SSV and to the $2^{nd}$ SSV are described herein as distinct operations. In embodiments, any two or more of the modifications can be performed using a single tool, or can be performed in the same operation. Likewise, these modifications may be progressed in any order. Thus, the step of cutting the wall of the $1^{st}$ SSV, the step of opening the fluid flow path for the $2^{nd}$ supply conduit 20 and the step of disabling the valve closure member 15 of the $1^{st}$ SSV may be performed using a single tool in a single operation, or by combining any combination of two steps in a single operation or by using separate tools in separate operations, in any order.

Figure 4:
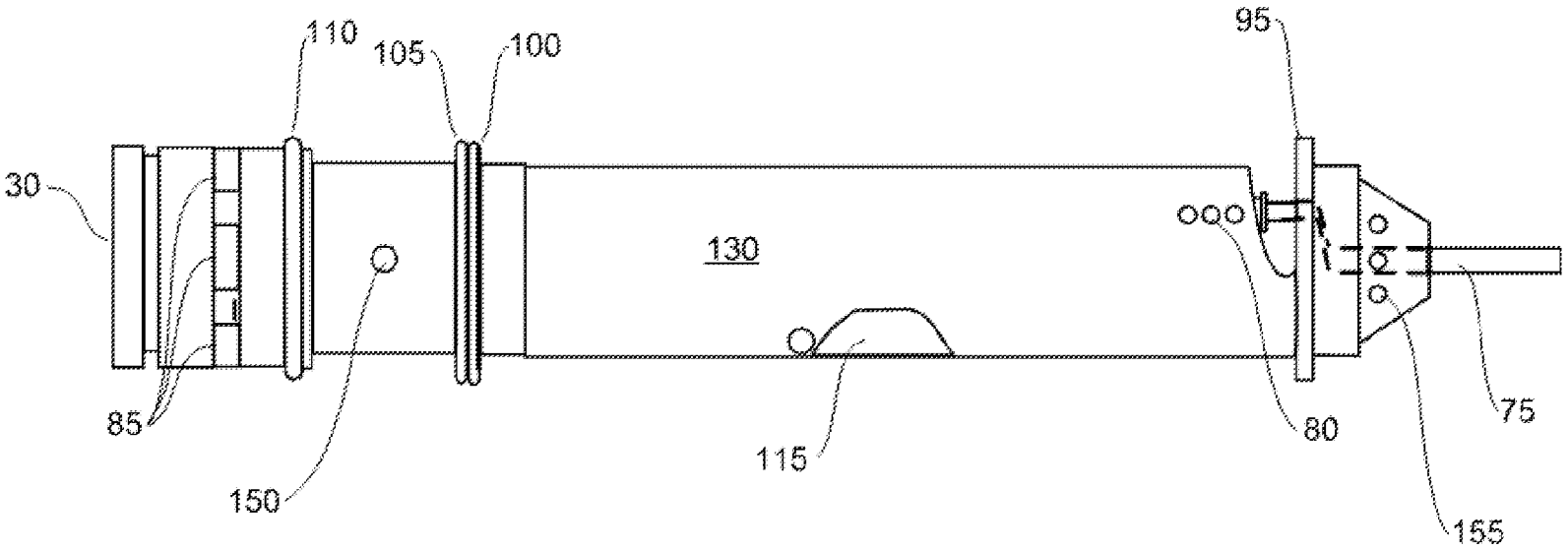
FIG. 4 illustrates an embodiment of the inner housing of the safety valve assembly.

The $2^{nd}$ SSV is more specifically illustrated in FIG. 4. An exemplary $2^{nd}$ SSV is a wireline surface controlled sub-surface valve (WSCSSV). The wireline SSV is installed with the production tubing in place, and is lowering into the production tubing while being suspended on a wire, a cable, a rope, a chain or a similar strand from the surface facility. In embodiments, the SSV is suspended from an electrical cable during installation, the electrical cable being used after installation to control the operation of the $2^{nd}$ SSV. The $2^{nd}$ SSV provides a $2^{nd}$ valve closure member 115 as the operating safety valve for the safety valve assembly. The $2^{nd}$ SSV is further provided with a downhole chemical injection line 75 extending below the SSV for conducting chemicals supplied into the SSV to the desired location within the production tubing and/or within the wellbore. The downhole chemical injection line is in fluid communication with one or more openings 80 in the body of the SSV.

FIG. 1 illustrates an embodiment of the safety valve assembly. The safety valve assembly comprises an outer housing 50 comprising a $1^{st}$ supply conduit 15 for supplying a $1^{st}$ fluid to the safety valve assembly and a $2^{nd}$ supply conduit 20 for supplying a $2^{nd}$ fluid to the safety valve assembly; an inner housing 130 fixed within the outer housing and comprising a valve closure member 115 and a $3^{rd}$ supply conduit 75 for supplying the $2^{nd}$ fluid to the wellbore; a $1^{st}$ annular volume 90 positioned between the outer housing 50 and the inner housing 130, the $1^{st}$ annular volume 90 being in fluid communication with the $1^{st}$ supply conduit 15 and with the $3^{rd}$ supply conduit 75; a $2^{nd}$ annular volume 125 positioned between the outer housing 50 and the inner housing 130, the $2^{nd}$ annular volume 125 being in fluid communication with the $2^{nd}$ supply conduit 20; wherein the valve closure member 115 in the inner housing is responsive to pressure changes of the $2^{nd}$ fluid.

In one embodiment, the outer housing 50 is a subsurface safety valve. In some such embodiments, the outer housing 50 is a tubing retrievable subsurface safety valve, integrally incorporated into the production tubing and attached at a first end 35 to at least one length of production tubing 45 extending from the subsurface safety valve toward the surface facility (not shown), and at a second end 40 to at least one length of production tubing 46 extending downward further into the wellbore. In embodiments, the inner housing 130 is a subsurface safety valve (otherwise termed a $2^{nd}$ subsurface safety valve). In some such embodiments, the inner housing 130 is a wireline surface controlled sub-surface valve. In embodiments, the method of assembling the safety valve assembly comprises installing the outer housing integral with the production tubing in a wellbore. The outer housing 50 is then modified to permit chemical delivery through the safety valve assembly into the wellbore, and to permit the insertion of the inner housing 130 into the safety valve assembly. In the embodiments illustrated in FIG. 1, examples of the desired modifications are described above. Such modifications include producing a machined port 120 in the outer housing 50, removing a plug 70 (illustrated in FIG. 2) in the $2^{nd}$ supply conduit 20 and disabling the action of a $1^{st}$ valve closure member 10 in the $1^{st}$ subsurface safety valve as originally installed. The inner housing 130 is then inserted into the outer housing 50 to provide an active valve closure member 115 as the operating safety valve for the safety valve assembly. Lock mandrels 85 are activated to fix the inner housing in place in the outer housing.

In the embodiment illustrated in FIG. 1, a $1^{st}$ annular volume 90 is in fluid communication with the $1^{st}$ supply conduit 15 via a machined port 120 and $1^{st}$ fluid chamber 25. The $1^{st}$ annular volume 90 is bounded by the outer housing 50 and the inner housing 130 and between a $1^{st}$ sealing element 95 and a $2^{nd}$ sealing element 100, each of which sealing element is positioned around the body of the inner housing 130 for providing a sealing function between the two housing surfaces. The $1^{st}$ annular volume 90 is further in fluid communication with a $3^{rd}$ supply conduit 75 for delivering chemicals to the wellbore, generally in a region below the safety valve assembly, via openings 80 in the body of the inner housing 130. During periods when chemicals are being injected into the wellbore through the safety valve assembly, the $1^{st}$ annular volume 90 is at least partially filled with the treatment chemical.

In some such embodiments, the $1^{st}$ supply conduit 15 is in fluid communication with a $1^{st}$ fluid chamber 25, which is in fluid communication, via the machined port 120, with the $1^{st}$ annular volume 90. The $1^{st}$ sealing element 95 and the $2^{nd}$ sealing 100 element maintain a separation of the fluid in the $1^{st}$ annular volume 90 (otherwise identified as the $1^{st}$ fluid) from the fluid in the $2^{nd}$ annular volume 125 (otherwise identified as the $2^{nd}$ fluid), and further maintain a separation of the fluids in the $1^{st}$ annular volume 90 and in the $2^{nd}$ annular volume 125 from production fluids passing through the safety valve assembly.

The $2^{nd}$ annular volume 125 is bounded by the outer housing 50 and the inner housing 130 and between a $3^{rd}$ sealing element 105 and a $4^{th}$ sealing element 110, each of which sealing element is positioned around the body of the inner housing 130 for providing a sealing function between the two housing surfaces against fluid flow out of or into the $2^{nd}$ annular volume 125. In embodiments, the $2^{nd}$ sealing element 100 and the $3^{rd}$ sealing element 105 are independent and distinct seal members, separated by a space of an arbitrary size. In other embodiments, the $2^{nd}$ and the $3^{rd}$ sealing element are independent and distinct sealing elements, abutting and touching each other along a portion of each seal's surface. In other embodiments, the sealing functions of the $2^{nd}$ and the $3^{rd}$ seal are provided by a single sealing element (i.e. references to a $2^{nd}$ sealing element and a $3^{rd}$ sealing element refer to the same physical sealing element element), with fluid contained in the $1^{st}$ annular volume contacting a portion of the external surface of the sealing element, and fluid contained in the $2^{nd}$ annular volume contacting a second portion of the external surface of the sealing element.

The $2^{nd}$ annular volume 125 is in fluid communication with the $2^{nd}$ supply conduit 20. In embodiments, the $2^{nd}$ annular volume 125 is in fluid communication with the $2^{nd}$ supply conduit 20 via a $2^{nd}$ fluid chamber 160. As discussed above, any plugs or obstructions originally present in the fluid flow channel between the $2^{nd}$ supply conduit 20 and the $2^{nd}$ annular volume 125 have been removed before operation of the safety valve assembly.

The inner housing further comprises a valve closure member 115 to provide protection to the production tubing in the event of an emergency. The valve closure member 115 is responsive to changes in pressure of the valve actuating fluid in the $2^{nd}$ annular volume 125. Loss or reduction in pressure may result in the valve closure member closing the production tubing to flow of produced fluids. In embodiments, valve closure member responses result from action of the fluid on linkage elements of the valve closure member. In some such embodiments, the fluid in the $2^{nd}$ annular volume 125 is in fluid communication with the linkage elements via the opening 150 in the inner housing 130. In some embodiments, the $2^{nd}$ valve closure member 115 is a flapper valve. The $2^{nd}$ supply conduit 20 is useful for supplying the valve actuating fluid for maintaining the $2^{nd}$ valve closure member 115 in an open position. The valve actuating fluid may be any fluid which remains a liquid during operation of the safety valve assembly and which is not detrimental to the operation of the safety valve assembly. In embodiments, the fluid is selected from the group consisting of hydraulic oils, including aviation grade hydraulic oils, mineral oils, aqueous solutions, water/glycol mixtures and mixtures thereof.

The $3^{rd}$ sealing element 105 and the $4^{th}$ sealing element 110 aid in preventing the mixing of the fluid in the $2^{nd}$ annular volume 125 with the fluid in the $1^{st}$ annular volume 90, and further aid in preventing the mixing of the fluid in the $2^{nd}$ annular volume 125 with produced fluids passing through the safety valve assembly. During normal operation of the safety valve assembly, fluid in the $2^{nd}$ annular volume 125 is at sufficient pressure to maintain the $2^{nd}$ valve closure member 115 in an open, flow-through position, via opening 150 in the inner housing 130. The $2^{nd}$ valve closure member 115 is activated by linkages, such as piston linkages and springs, in a structure similar to that described for the use of an active $1^{st}$ valve closure member 10 in the outer housing 50 prior to the $1^{st}$ valve closure member being disabled, as described above. The number, location, shape and dimensions of the one or more openings 150 in the inner housing 130 for providing fluid to control the flapper valve are not critical, so long as they meet specific requirements for flow rate, pressure drop and the design of the particular safety valve assembly. The particular configuration is not to be construed to be limited to the relative size and shape of the opening as illustrated in FIG. 1.

During operation of the safety valve assembly, a $1^{st}$ fluid comprising chemicals is permitted to flow through the $1^{st}$ supply conduit 15, which has been modified to accept chemical flow. The chemicals transported from the surface facility through the $1^{st}$ supply conduit 15 passes through the machined port 120 in the $1^{st}$ fluid chamber 25, into the $1^{st}$ annular volume between the outer housing 50 and the inner housing 130, through the at least one opening 80 in the inner housing 130 and into the downhole chemical injection line 75 below the safety valve assembly assembly. Thus, the $1^{st}$ annular volume is an element of the flowpath of the $1^{st}$ fluid.

A $2^{nd}$ fluid, which provides the control function for the $2^{nd}$ insert safety valve flapper 115, is provided by the $2^{nd}$ supply conduit 20, in communication with the $2^{nd}$ annular volume 125. Thus, the $2^{nd}$ annular volume is an element of the flowpath of the $2^{nd}$ fluid. The opening 150 in the inner housing 130 provides fluid communication between the $2^{nd}$ fluid chamber 160 and the mechanical linkages which control the insert safety valve flapper 115 and maintain the insert safety valve flapper 115 in an open position. Produced fluids rising through the production tubing pass into the flow path 30 of the safety valve assembly. FIG. 1 illustrates a portion of the flow route of the produced fluids, including passing through openings 155. The number, location, shape and dimensions of the one or more flow paths for production fluids through the safety valve assembly are not critical, so long as they meet specific requirements for flow rate, pressure drop and the design of the particular safety valve assembly. The particular configuration is not to be construed to be limited to the relative size and shape of the opening as illustrated in FIG. 1.

What is claimed is:

1. A safety valve assembly for use in a wellbore, comprising:

a. an outer housing comprising a first supply conduit for supplying a first fluid to the safety valve assembly and a second supply conduit for supplying a second fluid to the safety valve assembly;

b. an inner housing fixed within the outer housing and comprising a valve closure member and a third supply conduit for supplying the second fluid to the wellbore;

c. a first annular volume positioned between the outer housing and the inner housing, the first annular volume being in fluid communication with the first supply conduit and with the third supply conduit; and d. a second annular volume positioned between the outer housing and the inner housing, the second annular volume being in fluid communication with the second supply conduit;

wherein the valve closure member in the inner housing is responsive to pressure changes of the second fluid.

2. The safety valve assembly of claim 1, wherein the first annular volume is in fluid communication with the first supply conduit through a machined port.

3. The safety valve assembly of claim 2, wherein the machined port is formed within a safety valve assembly which is installed in the wellbore, with the safety valve assembly being attached at a first end to at least one length of production tubing and at a second end to at least one length of production tubing.

4. The safety valve assembly of claim 1, wherein the first supply conduit is in fluid communication with a surface facility.

5. The safety valve assembly of claim 1, wherein the first annular volume is at least partially filled with the first fluid.

6. The safety valve assembly of claim 1, wherein the first fluid is suitable for chemical treatment of the production fluids passing through the safety valve assembly.

7. The safety valve assembly of claim 1, wherein the first fluid is suitable for chemical treatment of the production tubing within the wellbore.

8. The safety valve assembly of claim 1, wherein the first fluid comprises at least one of a corrosion inhibitor, a scale inhibitor, or a foaming agent.

9. The safety valve assembly of claim 1, wherein the second supply conduit is in fluid communication with a surface facility.

10. The safety valve assembly of claim 1, wherein the second annular volume is at least partially filled with the second fluid.

11. The safety valve assembly of claim 1, wherein the second fluid is a valve actuating fluid selected from the group consisting of hydraulic oils, mineral oils, aqueous solutions, water/glycol mixtures and mixtures thereof.

12. The safety valve assembly of claim 1, wherein the first fluid is different from the second fluid.

13. The safety valve assembly of claim 1, further comprising at least one sealing element for preventing the mixing of the first fluid within the first annular volume with the second fluid within the second annular volume.

14. The safety valve assembly of claim 1, further comprising at least one sealing element for preventing the mixing of the first fluid with production fluid passing through the safety valve assembly and at least one sealing element for preventing the mixing of the second fluid with production fluid passing through the safety valve assembly.

15. The safety valve assembly of claim 1, wherein the outer housing is a tubing retrievable subsurface safety valve.

16. The safety valve assembly of claim 1, wherein the inner housing is a wire retrievable subsurface safety valve.

17. The safety valve assembly of claim 1, wherein the outer housing is attached at a first end to at least one length of production tubing extending from the safety valve assembly subsurface safety valve toward a surface facility and at a second end to at least one length of production tubing extending downward further into the wellbore.

18. A method for delivering a chemical treatment fluid to a wellbore, comprising:

a. installing a first safety valve, comprising a first supply conduit, a second supply conduit, a first fluid chamber and a first valve closure member, into a wellbore;

b. forming a machined port in an inner wall of the first safety valve to produce a pathway for fluid flow through the inner wall from the first fluid chamber;

c. installing a second safety valve within the first safety valve, wherein the second safety valve comprises a second valve closure member and a third supply conduit; and d. passing a first fluid through the first supply conduit, the first fluid chamber and the machined port and into the third supply conduit for chemical treatment of a production fluid and/or a production tubing.

19. The method of claim 18, wherein the step of installing a second safety valve within the first safety valve produces a first annular volume and a second annular volume.

20. The method of claim 19, wherein the first annular volume is an element of the flowpath of the first fluid.

21. The method of claim 19, wherein the second annular volume is an element of the flowpath of the second fluid.

22. The method of claim 18, further comprising passing a valve actuating fluid from the second supply conduit and into the second annular volume for controlling the second valve closure member.

* * * * *